United States Patent [19]

McKenney et al.

[11] Patent Number: 4,864,655

[45] Date of Patent: Sep. 12, 1989

[54] FIREFIGHTER'S TURNOUT COAT

[75] Inventors: Billie R. McKenney, Winchester, Ky.; Donald Aldridge, New Carlisle; Judy K. Webb, Centerville, both of Ohio

[73] Assignee: Lion Apparel, Inc., Dayton, Ohio

[21] Appl. No.: 231,506

[22] Filed: Aug. 12, 1988

[51] Int. Cl.[4] ..... A41D 13/00; A41D 3/02

[52] U.S. Cl. ..... 2/93; 2/81; 2/DIG. 4; 2/125

[58] Field of Search ..... 2/81, 85, 87, 93, 125, 2/243 B, DIG. 4

[56] References Cited

U.S. PATENT DOCUMENTS

| | | | |
|---|---|---|---|
| 2,012,206 | 8/1935 | Swint | 2/93 X |
| 4,604,759 | 8/1986 | Bowman et al. | 2/81 |
| 4,627,112 | 12/1986 | Grilliot et al. | 2/93 X |

*Primary Examiner*—Werner H. Schroeder
*Assistant Examiner*—Sara M. Current
*Attorney, Agent, or Firm*—Killworth, Gottman, Hagan & Schaeff

[57] ABSTRACT

A firefighter's turnout coat comprises a body portion cut to define armholes, shoulder sections, neck sections, a hem and a front opening of the coat wherein the shoulder sections are formed to include excess front to back material to form a shoulder having a shallow angle wherein shoulder pockets are formed at the upper ends of the armholes. Distances of the armholes to the hem of the body portion range preferably from 22–23 inches for a body portion having a length of approximately 35 inches. Full length sleeves include excess circumferential material within the mid-portions thereof to increase the fullness of the sleeves. Bellows for interconnecting the lower portions of the sleeves to the raised armholes are enlarged in their width dimensions such that firefighters wearing a turnout coat can raise their arms above their heads with substantially reduced ride-up of the hem and sleeves of the turnout coat to thereby reduce potential exposure of their torsos and wrists in a shorter, lighter weight coat.

7 Claims, 6 Drawing Sheets

---- PRIOR ART 134
130

132
128
122
122A
136
138
124
PRIOR ART

FIREFIGHTER'S TURNOUT COAT

BACKGROUND OF THE INVENTION

The present invention relates generally to protective clothing for firefighters and, more particularly, to a firefighter's turnout coat.

Firefighting is a very physically stressing activity which must be performed under conditions and in an environment which are bad under the best of circumstances. It is of course necessary for firefighters to wear clothing which protects them from the hostile fire environment and yet does so with the minimum weight and bulk to thereby reduce the stress placed on the firefighters. To this end, the upper portion of a firefighter is protected by an outer garment called a "turnout" coat which is made of flame resistant, water resistant and heat resistant material which also has a built-in moisture barrier. The lower portion of a firefighter is normally protected by protective bunker pants, and the turnout coat overlaps the top of the pan to protect the torso of the firefighter.

Many activities require firefighters to raise their arms above their heads; unfortunately, when prior art turnout coats are worn, the bottoms of the coats tend to rise up a substantial distance. Such ride-up can potentially expose the torso of the firefighter between the bottom of the turnout coat and the top of the protective bunker pants. The cuffs on the ends of the sleeves of prior art turnout coats also tend to ride-up substantially and risk the possibility of exposing the wrists of firefighters to the hostile fire environment.

To help ensure adequate protection for firefighters, prior art turnout coats are made sufficiently long such that torsos of firefighters are not exposed when they raise their arms above their heads. The additional length of the prior art coats adds to their weight and hence the physical stress placed upon firefighters.

Another piece of commonly employed firefighting equipment is self-contained breathing apparatus (SCBA) which is strapped to the back of the turnout coat. While the SCBA adds substantially to the weight which must be borne by a firefighter, it is obviously necessary in many operations. Unfortunately, with conventional turnout coats, the stress created by the SCBA is amplified by the substantial ride-up of the coat when the firefighters' arms are raised over their heads since the SCBA must also be raised by the firefighters.

Accordingly, there is a need for an improved turnout coat which facilitates extension of firefighters' arms above their heads and also substantially reduces ride-up of the coat bottom and the sleeve Wristlets while the wearers arms are raised. Such an improved turnout coat may be shorter in length and hence lighter in weight than prior art turnout coats and additionally reduces the energy which is otherwise required to effect the upward movement of the coat body on the firefighter's torso, particularly when the firefighter is using SCBA. Improvements in the design of a firefighter's turnout coat which allow for a shorter and lighter coat, provide more comfort and permit freer movement and hence less fatigue than prior art turnout coats provide not only advances in the art, but more importantly, better protection for firefighters.

SUMMARY OF THE INVENTION

Such advances in the art are made in the firefighter's turnout coat of the present invention. Initially, additional material is provided in the shoulders of the turnout coat to define a shallow shoulder angle, close to horizontal. The additional shoulder material also produces shoulder pockets at the upper ends of armholes of the turnout coat which permit the arms to be raised within the body of the coat without substantially raising the turnout coat itself. Full length sleeves include excess circumferential material within the mid-portions of the sleeves to increase their fullness. The armholes are raised in the turnout coat preferably to within a range of from 22 to 23 inches from the hem of the coat for a body portion having a length of approximately 35 inches. Bellows used to interconnect the lower portions of the sleeves to the arm holes are enlarged in their width dimensions which extend along the lengths of the sleeves to also permit the coat users arms to be extended above the user heads while applying substantially less force to the main body portion of the coat and hence, substantially reducing the ride-up of the coat. Finally, sleeve to neck dimensions of shoulder sections of the coat range from 6 to 7 inches to move the junctions of the sleeves and the shoulders toward the neck of the user and thereby reduce the pressure which is otherwise applied to the ball and socket area of the shoulder joints of firefighters wearing the coat.

In accordance with one aspect of the present invention, a firefighter's turnout coat comprises a body portion cut to define armholes, shoulder sections, neck sections, a hem and a front opening of the coat. The shoulder sections are formed to include excess front to back material such that when the shoulder sections are joined together, a shallow shoulder angle is defined and a shoulder pocket is formed at the upper ends of the armholes. The distances of the armholes to the hem of the body portion ranges preferably from 22 to 23 inches for a body portion having a length of approximately 35 inches. Full length sleeves include excess circumferential material within the mid-portions thereof to increase the fullness of the sleeves. Bellows for interconnecting the lower portions of the sleeves to the armholes are enlarged in their width dimensions which extend along the lengths of the sleeves such that firefighters wearing the turnout coat can raise their arms above their heads with substantially reduced ride-up of the hem and sleeves of the turnout coat to thereby reduce potential exposure of their torsos and wrists.

Preferably, the sleeve to neck dimensions of the shoulder sections range from 6 to 7 inches and the length of the full length sleeves is coordinated with the sleeve to neck dimensions of the shoulder sections to define a total neck to sleeve-end length of approximately 35 inches. The enlarged bellows range in width dimensions from 6 to 10 inches and in length dimensions from 14 to 16 inches. Patch pockets are preferably positioned adjacent the hem of the coat to prevent potential interference with the attachment of SCBA to the coat. To further protect and add to the comfort of firefighters, a reinforcement panel preferably formed of aramid fabric coated with fire retardant neoprene rubber is secured to an upper back portion of the shoulder sections and neck sections of the body portion of the coat. Such a reinforcement panel substantially reduces the possibility of burn injuries when this portion of the coat is compressed by upper body activity.

It is an object of the present invention to provide an improved firefighter's turnout coat to facilitate the ability of firefighters to raise their arms above their heads while wearing the turnout coat; to provide an improved firefighter's turnout coat wherein upward movement of the wearer's arms is facilitated by providing enlarged width bellows for interconnecting the lower portions of sleeves to armholes positioned higher within a body portion of the coat than in conventional turnout coat design; to provide an improved firefighter's turnout coat to facilitate the wearers' ability to reach above their heads by providing additional front to back material in shoulders of the coat such that a shallow shoulder angle is defined and a shoulder pocket is formed at the upper ends of the armholes of the coat; and, to provide an improved firefighter's turnout coat wherein additional circumferential material is provided within the mid-portions of full length sleeves of the coat to increase the fullness of the sleeves.

Other objects and advantages of the invention will be apparent from the following description, the accompanying drawings and the appended claims.

DETAILED DESCRIPTION OF THE INVENTION

Figure 1:
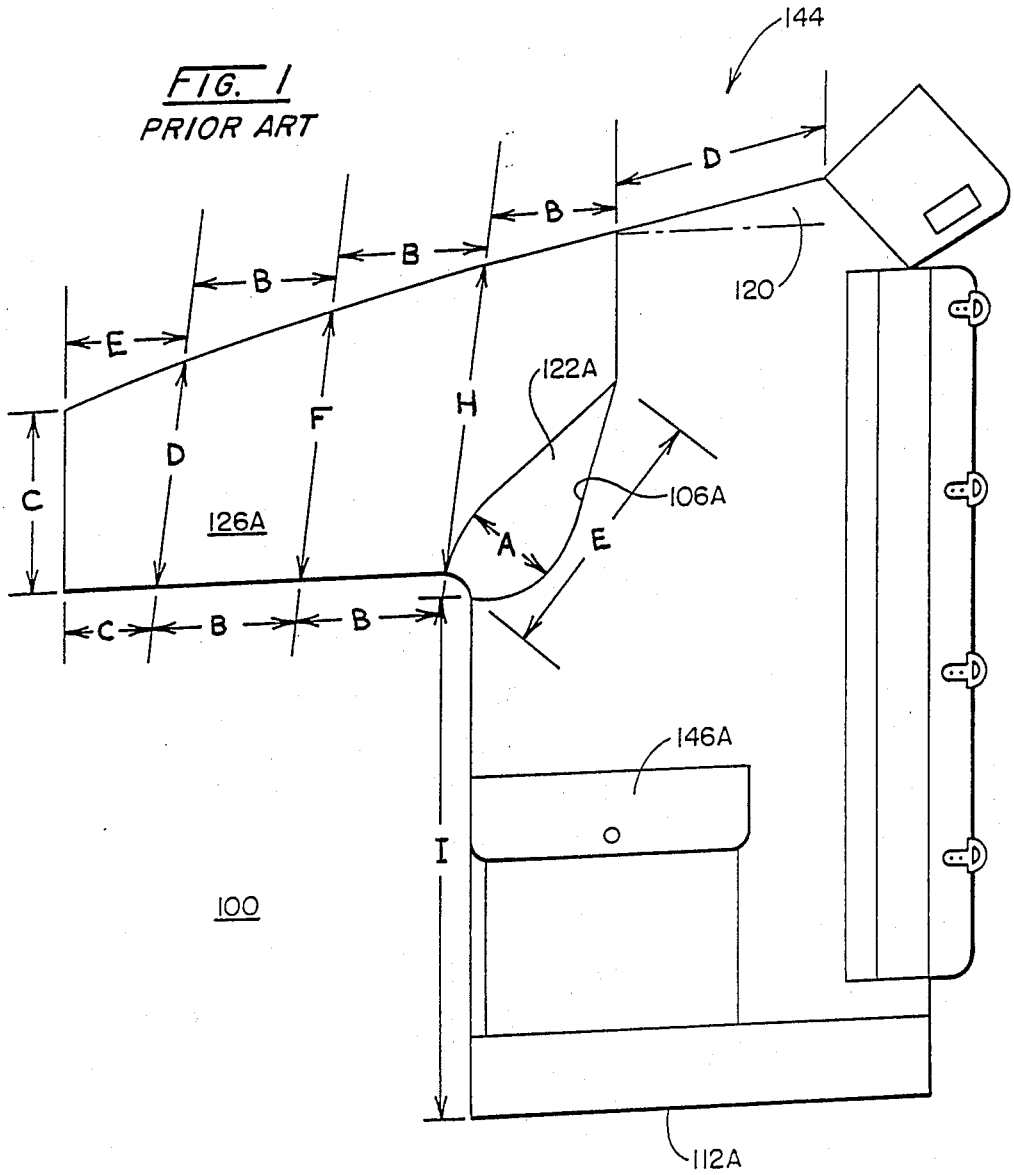
FIG. 1 PRIOR ART
FIG. 1 is a half front view of a prior art firefighter's turnout coat.
Figure 2:
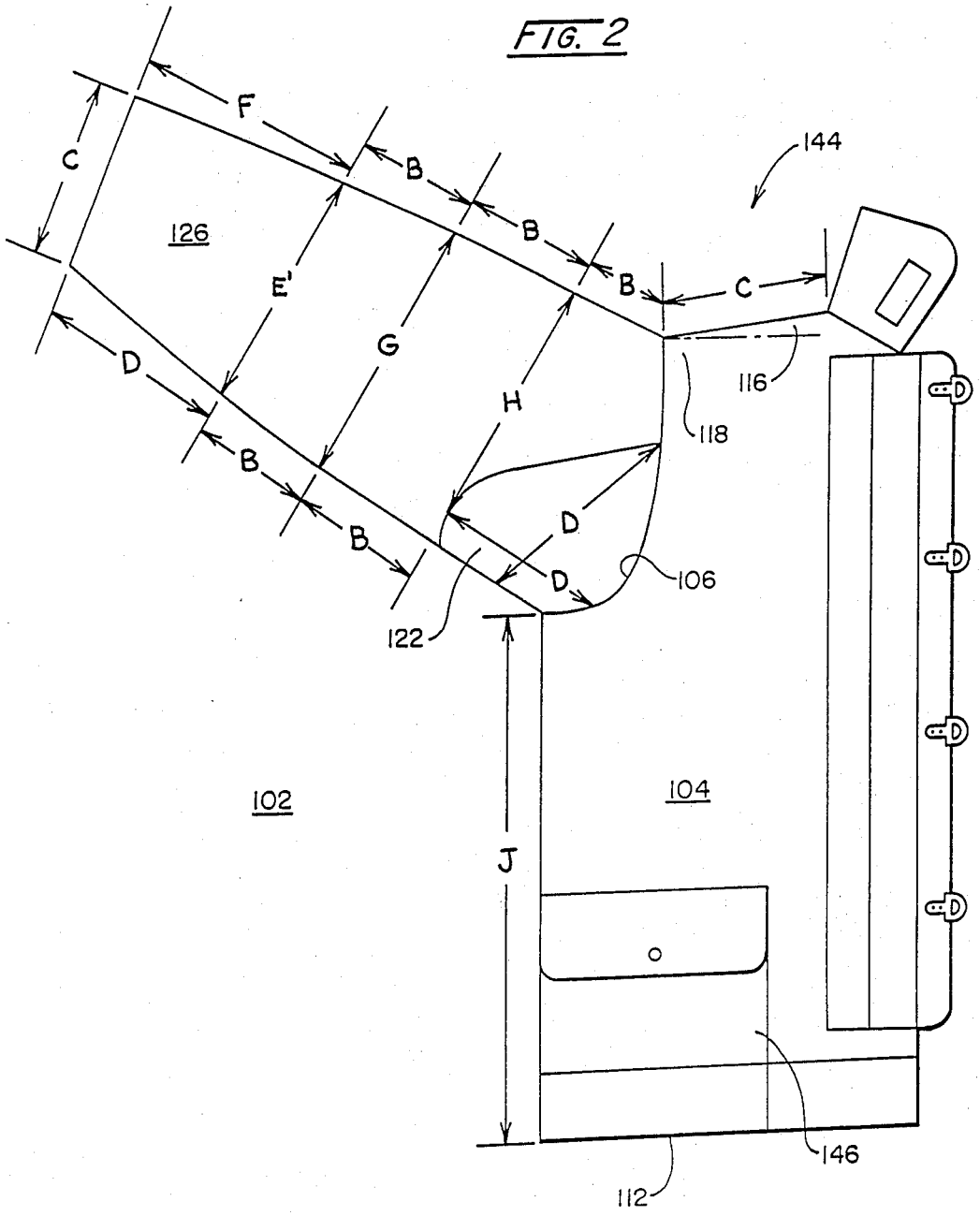
FIG. 2 is a half front view of a firefighter's turnout coat in accordance with the present invention.
Figure 3:
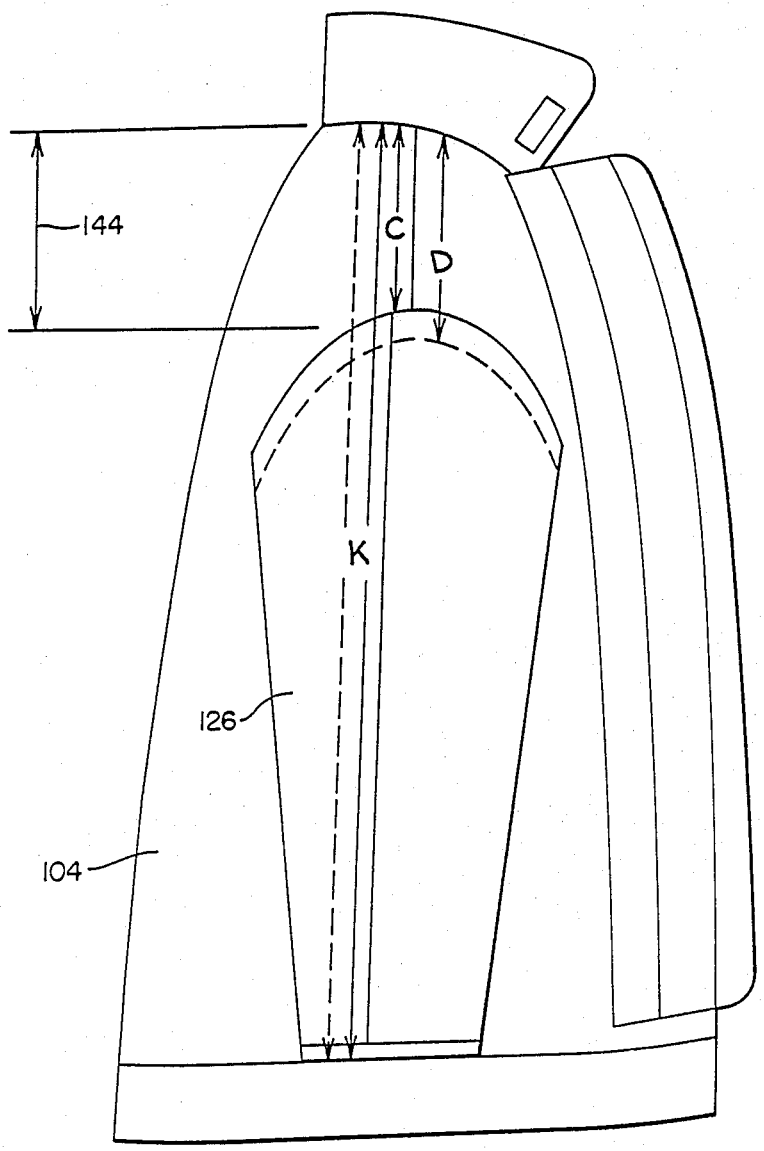
FIG. 3 is a side view of a composite firefighter's turnout coat showing the differences between the prior art coat and the coat of the present invention.

Referring to the drawing figures. FIG. 1 is a half front view of a prior art firefighter's turnout coat 100. FIG. 2 is a similar half front view of a firefighter's turnout coat 102 in accordance with the present invention. It is to be understood that the other halves of the coats are substantial mirror images of the halves shown with the exception that the other halves of the fastener strips with cooperating fasteners are incorporated into the halves of the coats which are not shown. A variety of improvements have been made in the turnout coat 102 which permit a shorter and lighter coat, provide more comfort for the firefighter and allow freer movement. Hence, the turnout coat 102 results in less fatigue and reduces the effort which must be exerted by firefighters extending their hands above their heads while also reducing the potential of exposing the firefighter's torsos and wrists. Alphabetically designed dimensions A–K of the prior art firefighter's coat 100 and the firefighter's coat 102 in accordance with the present invention as shown in FIGS. 1–3 are as follows: A-four (4) inches; B-six (6) inches; C-seven (7) inches; D-eight (8) inches; E-nine (9) inches; E'-nine and one half (9½) inches; F-ten (10) inches; G-eleven (11) inches; H-twelve (12) inches; I-twenty and one half (20½) inches; J-twenty two and one half (22½) inches; K-thirty five (35) inches.

Figure 4:
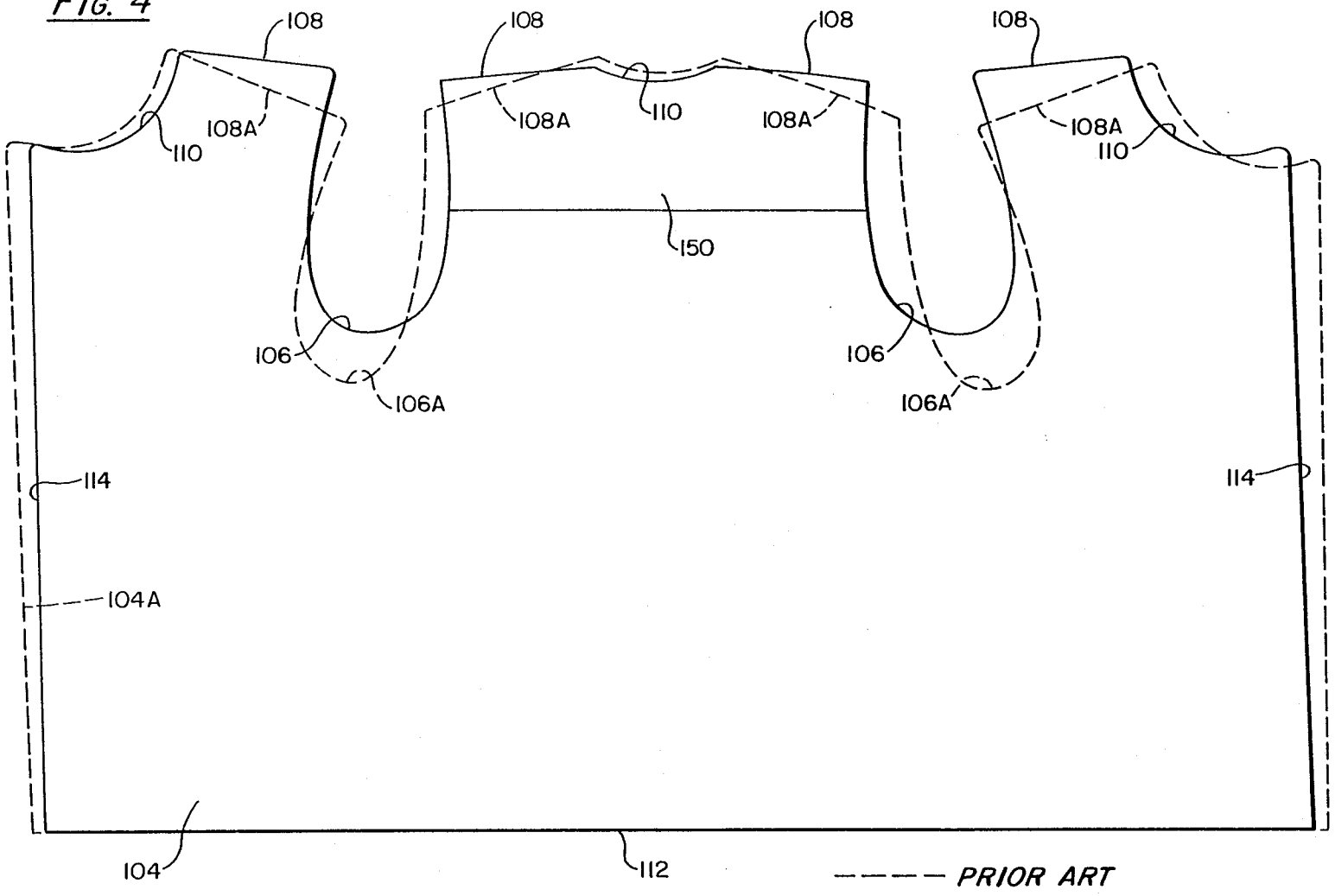
FIGS. 4–6 are composite views showing the differences between the body portions, the left sleeve and associated bellows, and the right sleeve and associated bellows of the prior art coat and the coat of the present invention

A body portion 104 of the firefighter's turnout coat 102 of the present invention is shown in solid line drawing in FIG. 4 and compared to the body portion 104A of a prior art coat which is shown in dashed line drawing in FIG. 4. The body portion 104 is cut to define armholes 106, shoulder sections 108, neck sections 110, a hem 112 and a front opening 114 of the coat 102. The shoulder sections 108 are formed to include excess front to back material as can be seen by their extension above the shoulder portions 108A of the prior art body portion 104A.

The excess front to back material provided in the shoulder sections 108 defines a shallow shoulder angle 116 when the shoulder sections 108 are joined together and also thereby forms a shoulder pocket 118 at the upper ends of each of the armholes 106. The shallow shoulder angle 116 of the firefighter's turnout coat 102 of the present invention may be compared to the shoulder angle 120 of the prior art coat 100 shown in FIG. 1. The shoulder pockets 118 permit the arms/shoulders of a firefighter to be raised to the extent of the pockets within the body of the coat 102 without substantially raising the coat itself and hence permit freer movement for a firefighter wearing the coat.

The distance of the armholes 106 to the hem 112 of the body portion 104 preferably ranges from 22–23 inches for a body portion having a length of approximately 35 inches. The raised position of the armholes 106 can be seen in the body portion 104 as a comparison to the armholes 106A of the prior art turnout coat 100 as well as in FIGS. 1 and 2 where it is indicated that the armhole opening 106 has been raised approximately two inches.

Figure 5:
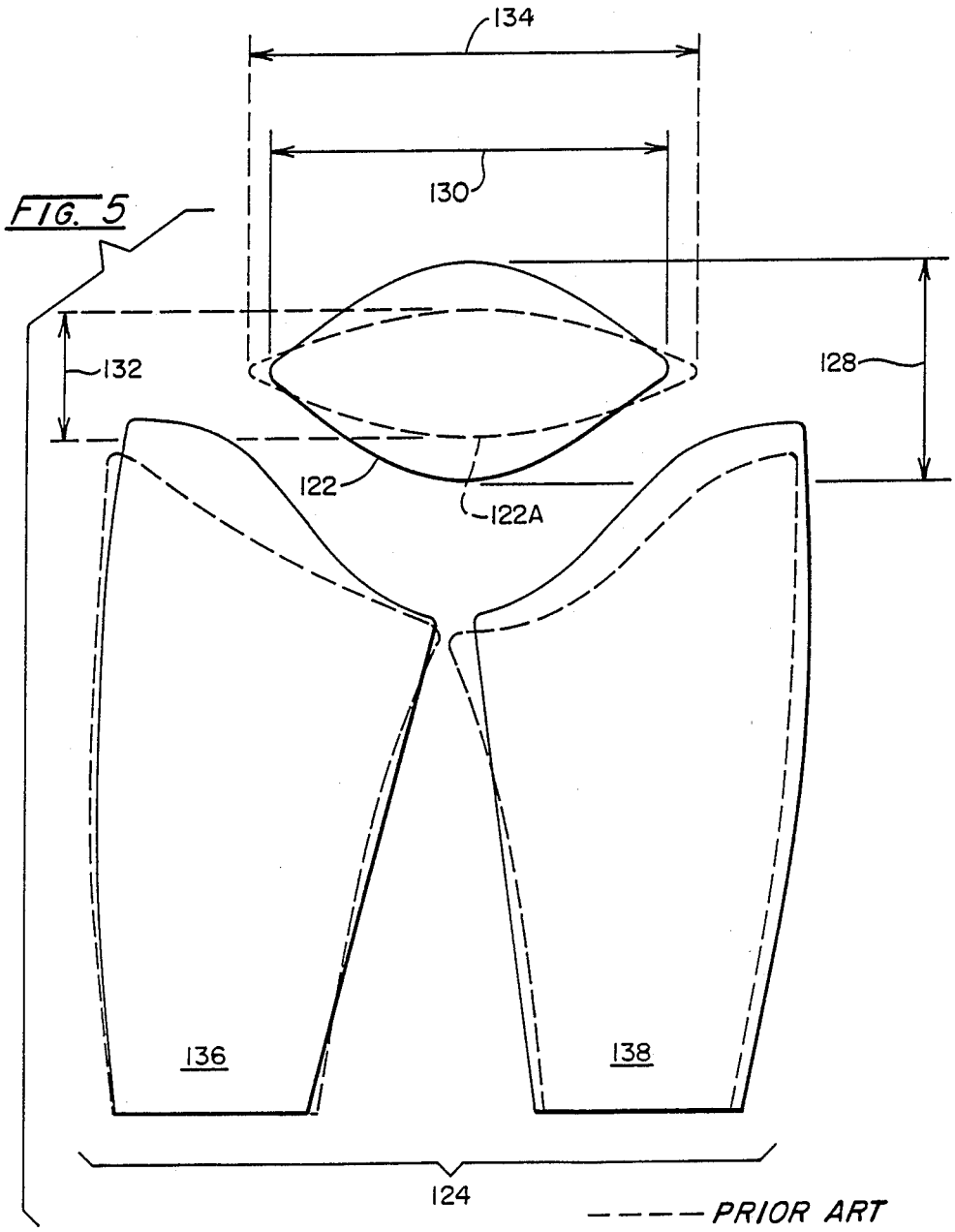
Figure 6:
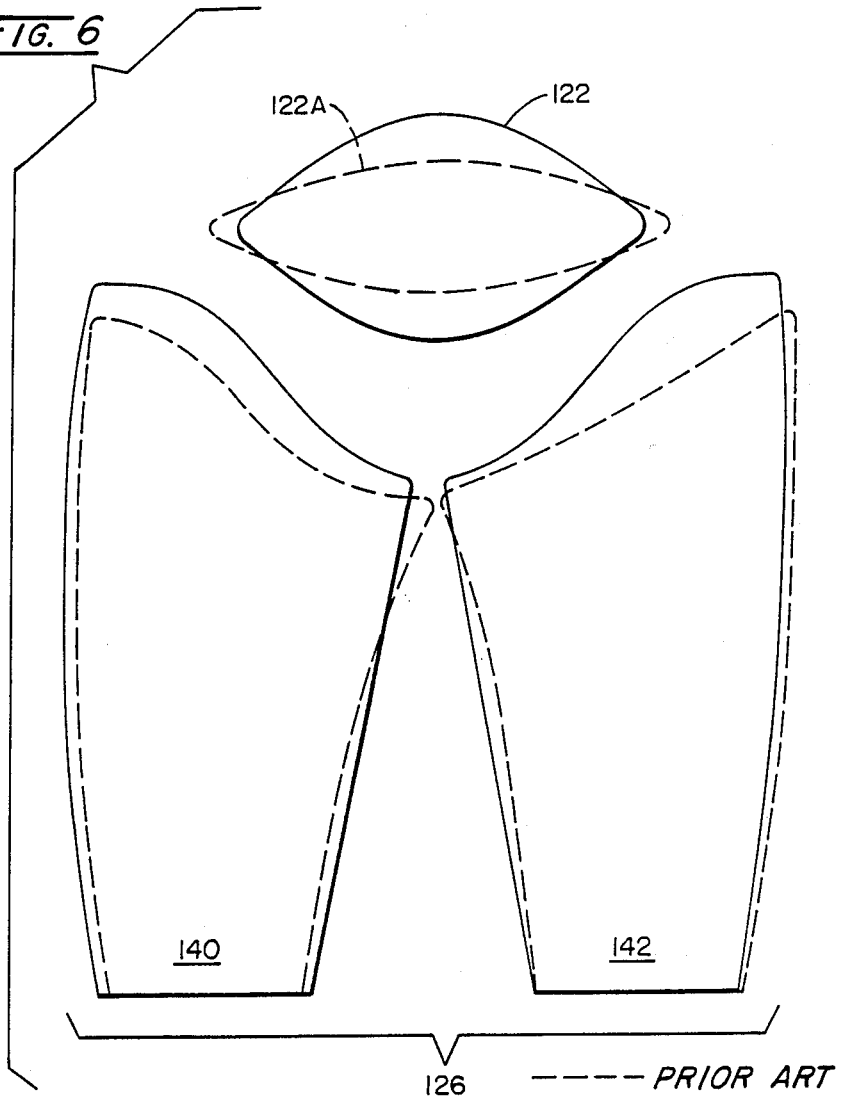

The raised armhole opening 106 in combination with a bellows 122 having an enlarged width dimension which extends along the length of the associated sleeve as shown in FIGS. 5 and 6 for the left sleeve and right sleeve, respectively, permits the sleeves of the firefighter's turnout coat 102 of the present invention to be raised substantially above the shoulder of the coat before an upward force is applied to the body portion 104 of the coat 102. The enlarged bellows 122 of the firefighter's turnout coat 102 of the present invention is generally elliptical in shape and has a preferred width dimension 128 of 8 inches; however, a range of 6 to 10 inches can be employed in the present invention. The bellows 122 has a preferred length dimension of 16 inches; however, a range of 14 to 16 inches can be employed in the present invention. This is compared to the prior art bellows 122A which has a width dimension 132 equal to 4 inches and a length dimension 134 equal to 18 inches. The advantages of the raised armhole 106 and enlarged bellows 122 can be seen by comparing the prior art coat 100 of FIG. 1 with the coat 102 of the present invention of FIG. 2.

The left sleeve 124 comprises a back portion 136 and a front portion 138 while the right sleeve 126 comprises a front portion 140 and a back portion 142. As can be seen from FIGS. 1, 2, 5 and 6, the full length sleeves 124 and 126 of the coat 102 include excess circumferential material within the mid-portions of the sleeves to increase the fullness of the sleeves 124 and 126 as is best shown by the sleeve dimensions of the turnout coat 102 of the present invention shown in FIG. 2 as compared to the sleeve dimensions of the prior art coat of FIG. 1.

To further improve the comfort of a firefighter wearing the turnout coat 102 of the present invention, the sleeve to neck dimensions 144 have been reduced from 8 inches in the prior art turnout coat 100 of FIG. 1 to a preferred sleeve to neck dimension of 7 inches which can range from 6–7 inches in accordance with the present invention. Such movement of the junction of the body portion of the coat 104 with the sleeves 124 and 126 serves to reduce the pressure which is otherwise applied to the ball-and-socket area of the shoulder joints of firefighters wearing the coat. This variation is shown in FIGS. 1, 2 and 3 which also illustrates that the length of the full length sleeves 124 and 126 are preferably coordinated with the sleeve to neck dimensions 144 of the shoulder sections 108 to define a total neck to sleeve end length of approximately 35 inches.

An additional feature of the firefighter's turnout coat 102 of the present invention is a lowering of a patch pocket 146 such that the bottom of the pocket 146 is aligned with the hem 112 of the body 104. The lower positioning of the pocket 146 facilitates the use of SCBA which is strapped to the back of the turnout coat 102 and in some instances the pocket 146A of the prior art coat 100 interfered with the strapping of the SCBA.

Still another feature of the firefighter's turnout coat 102 of the present invention is a reinforcement panel 150, as shown in FIG. 4, which is secured across an upper back portion of the shoulder sections 108 and neck sections 110 of the body portion 104. The reinforcement panel 150 is preferably made of aramid fabric coated with an application of fire retardant neoprene rubber to provide additional thermal barrier protection to firefighters wearing the coat. The additional protection provided by the reinforcement panel 150 substantially reduces the possiblity of burn injuries which can occur in prior art turnout coats if the upper back portion of a coat is compressed, for example, by arm extension crossing the chest area or other upper body activity.

The combination of the various features incorporated into the firefighter's turnout coat 102 of the present invention provides a shorter and lighter coat which is more comfortable and permits freer movement and reduced shoulder loading resulting in less fatigue than prior art turnout coats and better protection for firefighters. The combination of the raised armhole opening, enlarged bellows, more full sleeves, shallow shoulder angle and accompanying shoulder pockets provide a reduction of approximately 50% of the ride-up of the body portion of the coat when firefighters raise their arms above their heads and also a similar reduction in the ride-up of the sleeve along the arms of the firefighters.

In comparing samples of the prior art turnout coat 100 of FIG. 1 with samples of the improved turnout coat 102 of the present invention of FIG. 2, it has been found that body portion ride-up in the coat 100 is approximately 4–5 inches as compared to a body portion ride-up of approximately 2 inches in the new design, a reduction of around 50%. Sleeve ride-up is similarly reduced from a range of approximately 3½ to 4½ inches in the prior art design to a ride-up of approximately 2 inches in the coat of the present invention, again a reduction of about 50%.

having described the invention in detail and by reference to preferred embodiments thereof, it will be apparent that modifications and variations are possible without departing from the scope of the invention which is defined in the appended claims.

What is claimed is:

1. A firefighter's turnout coat comprising:

a body portion cut to define armholes, shoulder sections, neck sections, a hem defined by the bottom of said body portion and a front opening of said coat, said shoulder sections being formed to include excess front to back material such that when said shoulder sections are joined together shallow shoulder angles are defined by the resulting shoulders as they extend between the tops of said armholes and said neck sections and shoulder pockets are formed at the upper ends of said armholes, and the distance from the bottom of said armholes to said hem of said body portion ranges from 22–23 inches for a body portion having a length of approximately 35 inches measured from said neck sections to said hem;

full length sleeves including excess circumferential material within the middle 12–18 inches thereof to increase the fullness of said sleeves; and bellows for interconnecting said sleeves to said armholes, said bellows being enlarged in their width dimensions which extend along the lengths of said sleeves and being generally elliptical in shape with a width ranging from 6–10 inches and a length ranging from 14–16 inches whereby firefighters wearing said turnout coat can raise their arms above their heads with substantially reduced ride-up of said turnout coat body portion and said sleeves to thereby reduce potential exposure of their torsos and wrists.

2. A firefighter's turnout coat as claimed in claim 1 wherein the dimensions of said shoulder sections as they extend between the tops of said armholes and said neck sections range from 6–7 inches.

3. A firefighter's turnout coat as claimed in claim 2 wherein said full length sleeves are lengthened to coordinate with said shoulder sections as they extend between the tops of said armholes and said neck sections to define a total neck to sleeve end length of approximately 35 inches.

4. A firefighter's turnout coat as claimed in claim 3 wherein patch pockets thereon are positioned to have a lower edge thereof adjacent said hem.

5. A firefighter's turnout coat as claimed in claim 4 further comprising a reinforcement panel secured across an upper back portion of the shoulder sections and neck sections of said body portion whereby thermal barrier protection is increased to reduce burn injuries.

6. A firefighter's turnout coat as claimed in claim 5 wherein said reinforcement panel is made of aramid fabric having an application of fire retardant neoprene rubber.

7. A firefighter's turnout coat comprising:

a body portion cut to define armholes, shoulder sections, neck sections, a hem defined by the bottom of said body portion and the front opening of said coat, said shoulder sections being formed to include excess front to back material such that when said shoulder sections are joined together shallow shoulder angles are defined by the resulting shoulders as they extend between the tops of said armholes and said neck sections and shoulder pockets are formed at the upper ends of said armholes, the dimensions of said shoulder sections as they extend between the tops of said armholes and said neck sections range from 6–7 inches, and the distance from the bottom of said armholes to said hem of said body portion ranges from 22–23 inches for a body portion having a length of approximately 35 inches measured from said neck sections to said hem;

full length sleeves which are lengthened to coordinate with said shoulder sections as they extend between the tops of said armholes and said neck sections to define a total neck to sleeve end length of approximately 35 inches, said sleeves including excess circumferential material within the middle 12–18 inches thereof to increase the fullness of said sleeves; and generally elliptical bellows for interconnecting the lower portions of said sleeves to said armholes, said bellows being enlarged in their width dimensions which extend along the lengths of said sleeves to width dimensions of 8 inches and in their length dimensions to length dimensions of 16 inches whereby firefighters wearing said turnout coat can raise their arms above their heads with substantially reduced ride-up of said turnout coat body portion and said sleeves to thereby reduce potential exposure of their torsos and wrists.

* * * * *